United States Patent [19]

Emory

[11] 4,155,220

[45] May 22, 1979

[54] COMBUSTION APPARATUS FOR A GAS TURBINE ENGINE

[75] Inventor: John M. G. Emory, Middletown, Pa.

[73] Assignee: Westinghouse Electric Corp., Pittsburgh, Pa.

[21] Appl. No.: 761,047

[22] Filed: Jan. 21, 1977

[51] Int. Cl.[2] ..... F02C 7/22

[52] U.S. Cl. ..... 60/39.74 B; 239/406

[58] Field of Search ..... 60/39.74 R, 39.74 B, 60/39.65; 239/400, 404–406

[56] References Cited

U.S. PATENT DOCUMENTS

| | | | |
|---|---|---|---|
| 1,536,046 | 5/1925 | Anthony | 239/406 |
| 2,515,843 | 7/1950 | Te Nuyl | 239/406 |
| 3,121,996 | 2/1964 | Smith | 60/39.74 B |
| 3,215,351 | 11/1965 | Briggs | 239/406 |
| 3,498,055 | 3/1970 | Faitani et al. | 60/39.74 R |
| 3,763,650 | 10/1973 | Hussey et al. | 60/39.74 B |
| 3,775,039 | 11/1973 | Pillard | 239/406 |
| 3,831,854 | 8/1974 | Masai | 239/406 |
| 3,853,273 | 12/1974 | Bahr et al. | 60/39.74 R |
| 3,901,446 | 8/1975 | Petreikis et al. | 60/39.74 R |
| 4,044,553 | 8/1977 | Vaught | 239/405 |

*Primary Examiner*—Robert E. Garrett

*Attorney, Agent, or Firm*—F. A. Winans

[57] ABSTRACT

Combustion apparatus for a gas turbine engine for directing combustion air to enter the combustor adjacent the fuel oil nozzle in a vigorous swirling pattern to thoroughly mix with the atomized fuel to eliminate fuel rich, smoke producing pockets from the combustion zone. The apparatus includes air inlet ports directing one portion of the combustion air in an axially directed swirling motion, another portion of the air in a tangentially directed swirling motion with other portions of the air directed to cool and clean the nozzle and cool the wall of the combustor.

8 Claims, 3 Drawing Figures

COMBUSTION APPARATUS FOR A GAS TURBINE ENGINE

BACKGROUND OF THE INVENTION

1. Field of the Invention

The invention relates to an air and fuel injection apparatus for the combustion chamber of a gas turbine engine and more particularly to such an injection apparatus having an improved air admission pattern for reducing smoke generation and maintaining the face of a fuel oil nozzle relatively clean of carbon deposits.

2. Description of the Prior Art

Fuel injectors for admitting fuel oil to a combustion chamber of a gas turbine engine generally include a nozzle comprising a central orifice through which the oil is introduced and atomized in a conical pattern surrounded by air injecting apertures which mix air with the fuel and carry it into the primary combustion zone of the combustion chamber where it is mixed with additional combustion air and combusted to provide the hot motive gases for driving the turbine rotor.

Such fuel atomization and subsequent mixing with combustion air produces inhomogeneities in the air-fuel mixture such that even though sufficient air is introduced to the combustion zone to provide complete combustion, fuel rich pockets occur resulting in incompletely burned hydrocarbons which in turn result in smoke emissions. This smoke can be subsequently partially diluted by mixing the combustion products with dilution and cooling air downstream of the primary zone, but a better means is to eliminate the fuel rich pockets by a more vigorous mixing of the air with the fuel while maintaining the stability of the flame in the combustion zone.

In the present fuel nozzle, merely increasing the airflow into the primary combustion zone reduces the flame stability and increases the minimum outlet temperature at which blow-out occurs. Thus, the air-fuel mixture pattern must be altered in a manner such that the fuel rich pockets are eliminated but the flame remains stable even at low fuel flows.

SUMMARY OF THE INVENTION

The injection apparatus of the present invention generally utilizes the fuel oil nozzle of the prior art but also directs an increased portion of the combustion air to enter the combustor adjacent the face of the nozzle for immediate and vigorous mixture with the atomized fuel oil in a controlled flow pattern to eliminate inhomogeneities in the fuel-air mixture in the primary combustion zone. A portion of this combustion air also is directed to flow across the face of the fuel oil nozzle to maintain the nozzle face cool and relatively free of carbon deposit build-up. The apparatus of the preferred embodiment also includes a plurality of ports encircling the fuel oil nozzle for introducing, alternatively, fuel gas into the combustor. The direction of entry through these ports is codirectional with the combustion air entry at the nozzle face and the combustion characteristics of the gas or oil are not altered thereby. However, it is foreseeable that such fuel gas port locations can alternatively be employed for injecting additional combusion air into the combustor in the immediate vicinity of the fuel nozzle in a pattern consistent with the combustion air introduced through the other air passages of the apparatus if a further reduction in smoke emission with flame stability is desired when combusting fuel oil.

DESCRIPTION OF THE PREFERRED EMBODIMENT

The apparatus of the present invention includes a fuel oil injecting nozzle for a gas turbine engine such as shown and described in commonly assigned U.S. Pat. No. 3,826,080 wherein a fuel oil nozzle in the combustion chamber of a gas turbine engine is sufficiently described for reference to be made thereto to supplement the instant description.

Figure 1:
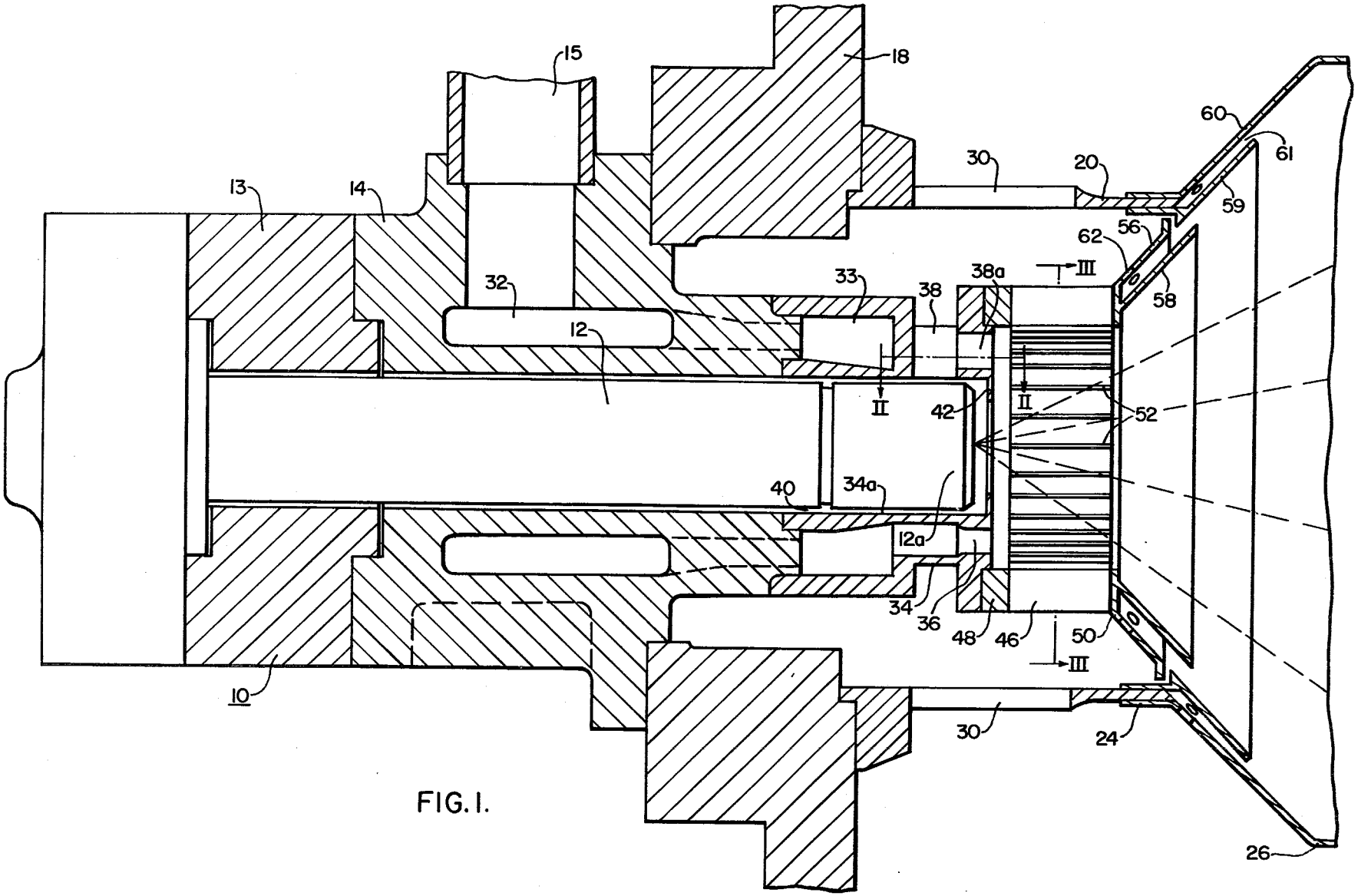
FIG. 1 is a cross-sectional elevational view of the combustion apparatus of the instant invention.

Thus, referring to FIG. 1 herein, the combustion apparatus 10 of the present invention includes a fuel oil nozzle 12 such as shown and described in the aforementioned patent. The nozzle 12 is supported at one end in a fuel nozzle mounting plate 13 which in turn is attached to a fuel gas manifold collar 14 encircling the nozzle. The collar 14 is attached to a combustor cover plate 18 which can form a part of the combustor shell or housing of the turbine. An open-ended cylindrical combustor neck 20 is sealingly attached at one end to the cover plate 18 and encircles the fuel injecting end **12*a* of the nozzle 12 in a spaced relation. The opposite end of the neck is telescopically received in the annular flange 24 defining the inlet to the combustor chamber 26 for supporting the chamber within the housing. The cylindrical wall of the neck 20 contains a plurality of large openings 30 for admitting compressed air in the combustor shell into the interior of the neck 20** for subsequent entry into the upstream open end of the combustion chamber.

The fuel gas manifold 14 comprises a fuel gas inlet 15 leading to an annular distribution passage 32 in flow communication with an annular cavity 33 in an axial swirler collar 34 having alternatingly axially directed fuel gas orifices 36 in communication with the cavity 33 and air orifices 38 extending radially through the collar 34 adjacent the fuel injecting end **12*a* of the nozzle 12. Orifices 38 also define a forwardly facing generally axially directed opening 38*a*** for directing air in a downstream direction.

The collar 34 defines an annular space 40 between its inner wall **34*a* and the fuel oil nozzle 12, and also, a radially directed annular lip 42** extending partially over and spaced from the generally planar face of the nozzle.

The air orifices 38 thus provide airflow communication through the collar 34 from the space within the combustor neck to the face of the nozzle as directed by the lip 42 and also to discharge air through the forward face of the swirler collar in an alternating array of gas and air orifices 36 and **38*a*** respectively.

A tangential swirler 46 is attached to the forward face of the axial swirler collar 34 and comprises a pair of axially opposed annular rings 48, 50 connected by a plurality of circumferentially spaced generally tangentially directed fins 52 extending from the outer periphery of the rings to generally adjacent the forwardly open air orifices **38*a* of the axial swirler. The channels between adjacent fins thus provide airflow communication from the space within the combustor neck 20** to just downstream of the nozzle face.

A pair of concentric frustoconical baffles 56, 58 extend from the ring 50 into the combustion chamber 26 generally parallel to a conical portion 60 of the combustor. Another frustoconical baffle 59 is attached to the neck 20 to define an annular space 61 between this baffle 59 and conical portion 60. A series of small openings 62 at the upstream end of the outer baffle 56 permits a metered amount of the air within the neck 20 to flow into the space between the inner 58 and outer 56 baffles to provide a film of cooling air on the downstream facing portion of the downstream baffle 59. The conical portion 60 also has a series of small openings 64 to permit a metered amount of air into the space 61 to provide a film of cooling air along the inner surface of the combustor 26.

Figure 2:
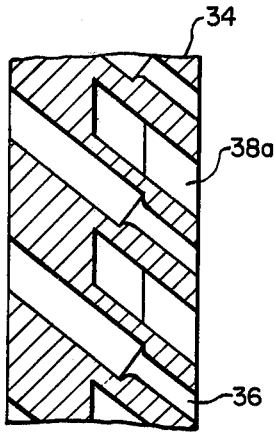
FIG. 2 is a cross-sectional view along lines II—II of FIG. 1.

Referring now to FIG. 2, a partial view of the axial swirler collar 34 is shown to illustrate that both the axially directed air passages 38*a* and the fuel gas orifices 36 are disposed at an angle with respect to the axis to impart an angular axial flow to the respective fluid flowing therethrough. Such angle will be on the order of 45° with respect to the axis and results in a helically confined flow path.

Figure 3:
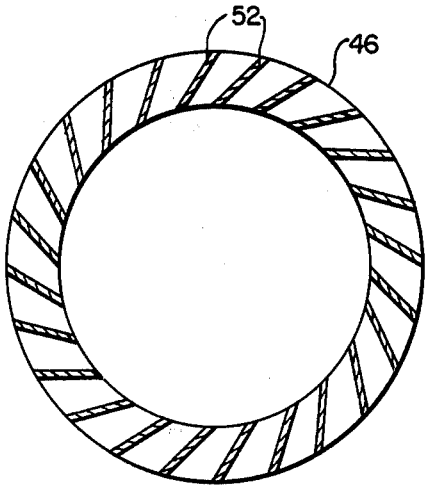
FIG. 3 is a cross-sectional view generally along lines III—III of FIG. 1.

Referring now to FIG. 3, it is therein seen that the fins 52 of the tangential swirler 46 are also inclined so that the air entering through the channels between adjacent fins does not do so radially but angularly such as again at a 45° angle with respect to a radial direction.

The rotational flow so imparted to the air by the tangential swirler 46 is complementary, i.e., co-rotational, to the helical flow imparted by the axial swirler 34 so that the combustion air introduced via the swirlers is given an effective motion that intercepts the conical (i.e., shown in phantom) discharge of the fuel oil nozzle to provide confined vigorous mixing between the combustion air and the fuel during the travel of the fuel into the primary combustion zone of the combustion chamber. Thus, the confined mixing of increased quantities of combustion air with the fuel in a vigorous helical configuration generally insures that no fuel rich pockets exist in the combustion zone, yet the flame remains stable in that the angular entry of the air exiting the swirlers provides a recirculation of the mixture in this zone.

Thus, in operation, it is expected that about 15 to 20% of the airflow through the combustor will enter at the upstream end of the combustor through the openings 30 in the combustor neck 20, with the remainder of the air entering as additional primary combustion air, or film cooling air through downstream slots, and secondary or profiling air entering apertures adjacent or in the transition zone as is well known in the art. Of the air entering the combustor neck it is expected that about 25% will enter the axial swirler air passage 38 with the major portion of this air exiting through air orifices 38*a* in the axial swirl pattern; however, a sufficient quantity continuously flows across the face of the fuel oil nozzle 12 as directed by the lip 42 to maintain the nozzle relatively cool and free of carbon build-up prior to flowing downstream into the combustion chamber. Approximately 60% of the air entering the neck 20 is expected to flow into the channels of the tangential swirler 46 to impart a tangential inwardly confining swirl direction to the major portion of the combustion air that forcefully intercepts the conical spray output of the fuel oil nozzle to efficiently mix therewith. The remainder of the air, i.e., about 15%, is expected to enter the openings 62 to flow between the outer baffle 56 and the inner baffle 58 directing it to cool the wall of the downstream baffle 59. Air entering slot 61 through apertures 64 provides a cooling airflow into the combustor to cool the inner face of the combustor. And although the primary purpose of the film cooling air is to cool the adjacent components, it is inherent that at least some of this air, along with other air introduced into the combustor downstream of the inlet area, will provide additional combustion air.

It is to be understood that the entry of the combustion air in the above-described manner when fuel gas is being burned as provided through fuel gas orifices 36 does not in any way interfere with the burning of such gas, or alter the flame characteristics. Alternatively, during firing with fuel oil, if there is a necessity for even more air to enter the primary zone for mixing with the fuel oil, the fuel gas orifices can be connected to the combustor airflow source as by providing flow communication through inlet 15 to within the housing to deliver air therethrough to exit in the same axial swirl pattern imparted to air entering the combustor neck for even greater air mixing of the fuel oil.

Thus, a combustion apparatus is provided which directs combustion air into the primary zone of the gas turbine combustor in a pattern which causes efficient confined mixing between the air and the fuel oil introduced into the air pattern for reduction of fuel rich pockets that could otherwise produce smoke. Further, a portion of the air is directed to flow across the face of the fuel nozzle to maintain that face relatively clear of carbon deposits and to keep it relatively cool. Further, the apparatus is compatible with a nozzle having dual fuel capabilities and permits those entry ports generally associated with gaseous fuels to also be utilized for introducing more air into the primary combustion zone in a manner compatible with and supplementing the mixing air to increase the air mixing with the fuel and further reduce the smoke-generating characteristics of a fuel oil atomizing nozzle.

I claim:

1. Combustion apparatus for a gas turbine engine having a housing enclosing a generally open-ended combustion chamber supported therein for admitting pressurized air from within said housing to the upstream open end of said chamber for supporting primary combustion therein, said apparatus comprising:

a fuel nozzle for discharging liquid fuel into said combustion chamber adjacent said upstream open end thereof;

a collar member encircling said fuel nozzle generally adjacent the discharge end thereof in a spaced relationship providing an annular space therebetween, said member defining a plurality of individual radially directed passages for airflow communication from within said housing to said annular space, and an annular lip extending from said collar radially inwardly and in spaced relation to the nozzle face to direct air in said annular space across said nozzle face, a plurality of first passages extending axially through said collar in a helical configuration and having an inlet in said housing providing flow communication through said passages from within said housing to substantially adjacent the open end of said combustion chamber, and a plurality of second passages extending axially through said collar in a helical configuration from a separate confined cavity adjacent said nozzle to substantially adjacent the open end of said combustion chamber, said first and second passages imparting a codirectional helical discharge to fluid flowing therethrough; and, means downstream of the discharge of said first and second passages defining a plurality of individual generally tangentially directed air passages for airflow communication from within said housing to substantially adjacent the open end of said combustion chamber;

whereby pressurized air from within said housing is directed into the open end of said combustion chamber as primary combustion air with a portion of said air entering through said first passages and having an axially swirling helical motion and another portion of said primary air having a tangentially swirling motion as directed by said tangential passages to provide confined mixing of said primary air with the fuel introduced by said nozzle, and a limited portion of air directed across said nozzle face to prevent carbon build-up thereon.

2. Structure according to claim 1 wherein said second passages are alternatively connected to a fuel gas supply or a primary combustion air supply.

3. Structure according to claim 1 further including a first baffle member concentric with the wall defining the inlet to the combustion chamber and closely spaced therefrom, and openings in said wall to provide airflow into said space for a film of cooling air over said wall as directed by said baffle member.

4. Structure according to claim 3 wherein said means defining said tangential passages also supports a pair of closely spaced concentric baffle members with the radially outermost of said latter baffle members being in substantial alignment with said first baffle member and containing apertures for admitting airflow to the space between said latter baffle members for directing a film of cooling air across the face of said first baffle member as confined by the radially innermost of said latter baffle members.

5. In a gas turbine engine having a combustion chamber and a fuel nozzle disposed adjacent the open inlet end of said chamber for admitting liquid fuel therein for combustion within said chamber, means disposed adjacent the discharge end of said nozzle for confining the primary combustion air entering said open end of said chamber to a swirling motion to enhance complete mixture of the air and fuel prior to combustion, said means also including a plurality of passages for admitting gaseous fuel to said combustion chamber, said means comprising:

a collar member encircling the nozzle adjacent the discharge end in an annular spaced relationship, said member defining an annular confined fuel gas cavity therein and a plurality of first and second passages extending through an axial extent of said member in an alternating arrangement and angularly disposed with respect to the axis, entry ports into said first passages for providing flow communication of primary combustion air therethrough from adjacent said nozzle to enter said combustion chamber in a generally helical swirl as directed by said first passages and said second passages providing flow communication from said confined fuel gas cavity to said combustion chamber and imparting a similar helical swirl to fluid flowing therethrough, said member further defining a plurality of generally radially extending passages for airflow communication to said annular space and an annular lip extending radially inwardly to overlie in spaced relationship a portion of the face of the nozzle to direct airflow in said annular space across said nozzle face; and, means defining tangentially extending passages disposed between the discharge of said first and second passages and the primary zone of the combustion chamber for airflow communication in a tangential swirl path to intercept the axial swirl path of fluid exiting the collar member to provide a generally confined mixing of said primary combustion air and said fuel injected by said nozzle in a generally helical swirl adjacent the open inlet end of said combustion chamber.

6. Structure according to claim 5 wherein said confined fuel gas cavity is supplied with said primary combustion air whereby both first and second passages provide swirling combustion air into said combustion chamber.

7. Structure according to claim 5 further including a first baffle member concentric with the wall defining the inlet to the combustion chamber and closely spaced therefrom, and openings in said wall to provide airflow into said space for a film of cooling air over said wall as directed by said baffle member.

8. Structure according to claim 7 wherein said means defining said tangential passages also supports a pair of closely spaced concentric baffle members with the radially outermost of said latter baffle members being in substantial alignment with said first baffle member and containing apertures for admitting airflow to the space between said latter members for a film of cooling air across the face of said first baffle member as directed by the radially innermost of said latter baffle members.

* * * * *